US005135126A

United States Patent [19]

Petit

[11] Patent Number: 5,135,126

[45] Date of Patent: Aug. 4, 1992

[54] CASE EQUIPPED WITH A ONE-PIECE CLASP

[75] Inventor: Robert Petit, Chevilly-Larue, France

[73] Assignee: Lir France, Chevilly-Larue, France

[21] Appl. No.: 731,519

[22] Filed: Jul. 17, 1991

[30] Foreign Application Priority Data

Jul. 19, 1990 [FR] France ..... 90 09239

[51] Int. Cl.[5] ..... B65D 45/18

[52] U.S. Cl. ..... 220/326; 220/324

[58] Field of Search ..... 220/326, 324

[56] References Cited

U.S. PATENT DOCUMENTS

| | | | |
|---|---|---|---|
| 3,323,676 | 6/1967 | Poittevin | 220/324 |
| 4,792,055 | 12/1988 | Schupack | 220/324 X |
| 4,901,882 | 2/1990 | Gonealves | 220/324 |
| 4,940,140 | 7/1990 | Posso | 220/324 X |

FOREIGN PATENT DOCUMENTS

| | | |
|---|---|---|
| 3735320 | 8/1989 | Fed. Rep. of Germany . |
| 2512650 | 3/1983 | France . |

*Primary Examiner*—Steven M. Pollard
*Attorney, Agent, or Firm*—Helfgott & Karas

[57] ABSTRACT

Case composed of two parts articulated to one another and comprising a one-piece clasp comprising a body on which are provided retention means, elastic return means, actuating means accessible from outside and locking means. The body (7) of the clasp (1) is constructed so that it can be introduced into the first case part (3) by sliding through an opening (4) and the retention means (15) cooperate, at the end of this mounting by sliding, by snapping in, with stop means (19) provided on the first case part (3) so as to enable the locking means (12) to cooperate with hooking means on the second case part (6).

Application: in particular to make-up cases.

5 Claims, 2 Drawing Sheets

CASE EQUIPPED WITH A ONE-PIECE CLASP

The present invention relates to a case which is composed of two parts articulated to one another and is equipped with a one-piece clasp comprising a body capable of being slidably mounted in a first part of the case, on which body are provided retention means for defining a first position of the said body in the said first case part, elastic return means for urging the said body elastically to the said first position, means, accessible from outside, for actuation through an opening in the said first case part, for displacing the said body by manual pressure counter to the action of the said return means, and locking means for keeping the case closed.

On known cases of this type, in particular makeup cases, such a one-piece clasp comprises a body from which two branches forming the elastic return means project laterally, on two opposite sides, these two branches cooperating, by bending, with two lateral supports provided on the first case part. Owing to the presence of these two laterally projecting branches on the body, the first case part must necessarily be constructed in two pieces, namely a bottom and a covering piece, the clasp being mounted in the bottom before putting the covering piece in place. This complicates assembly of the case and increases the cost of the latter.

The subject of the present invention is a case having a one-piece clasp which, while being simple in terms of structure and manufacturing, can be mounted in the final stage of assembly of the case.

In the case according to the invention, the clasp body is constructed so that it can be introduced into the said first case part by sliding through the said opening in the said case part and so that the said retention means cooperate, at the end of this mounting by sliding, by snapping in, with stop means provided on the first case part so as to enable the said locking means to cooperate with hooking means provided on the second case part, under the action of the actuating means and of the elastic return means.

Such an assembly implies that the elastic return means do not extend laterally beyond the body of the clasp. This is why, according to the invention, the said return means are formed on the body of the clasp in the extension of the latter, in the direction in which the clasp is introduced into the first case part, so as to cooperate, by elastic bending, with bearing means provided on the first case part.

According to one embodiment of the invention, the return means can consist of two oblique lateral branches converging in the direction in which the clasp is introduced into the first case part and bearing via their free ends against a bearing means arranged in the first case part in the extension of the said introduction opening.

In this instance, the retention means can advantageously be formed by catches projecting laterally from the body of the clasp at the root of the two branches constituting the return means, whereas the stop means consist of the interior opposite lateral edges of the said opening in the first case part.

According to another embodiment of the invention, the return means and the retention means are formed on the body so as to be offset downwards relative to the lower edge of the body, while being elastically connected to the body with the possibility of pivoting in a vertical plane. The return means and the retention means can thus engage elastically, upon introduction of the clasp by sliding into the first part of the case, in a recess made in the said case part in such a way that one of the flanks of the said recess constitutes the said stop means and the other flank constitutes the said bearing means.

In this instance, the return means can have the form of a closed loop, preferably a diamond-shaped loop.

To facilitate the elastic pivoting movement of the return means and the retention means upon introduction of the clasp into the first case part, it is advantageous to provide, at the location of the junction of the return means and retention means with the clasp body, a weakened region serving as pivot axis.

With reference to the accompanying schematic drawings, a more detailed description will be given below of two illustrative and non-limiting embodiments of a case with clasp according to the invention:

Figure 1:
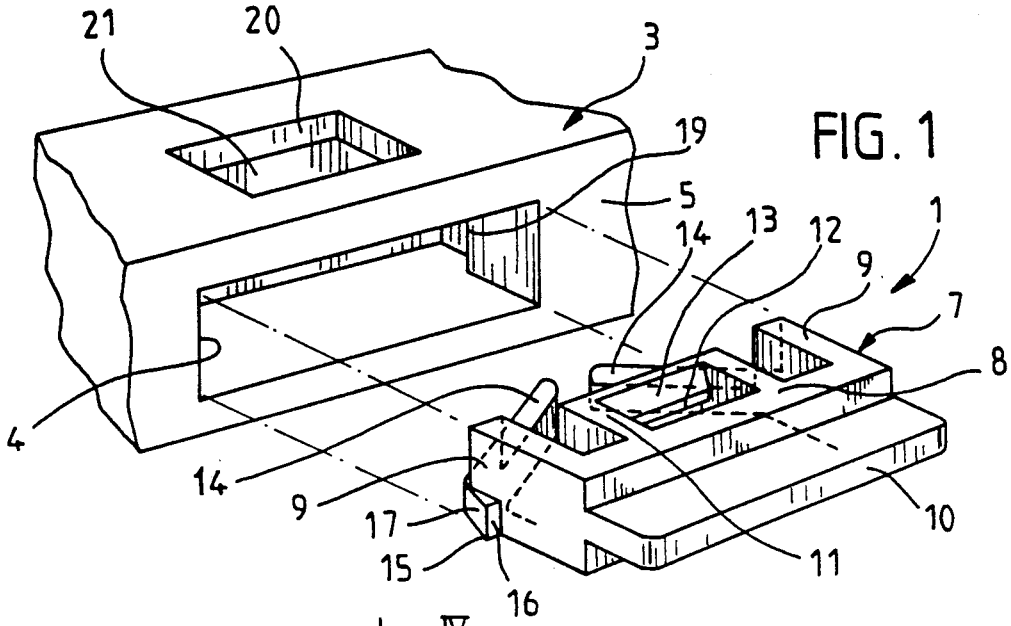
FIG. 1 is a perspective view of a clasp according to a first embodiment of the invention, before mounting thereof in the case.
Figure 2:
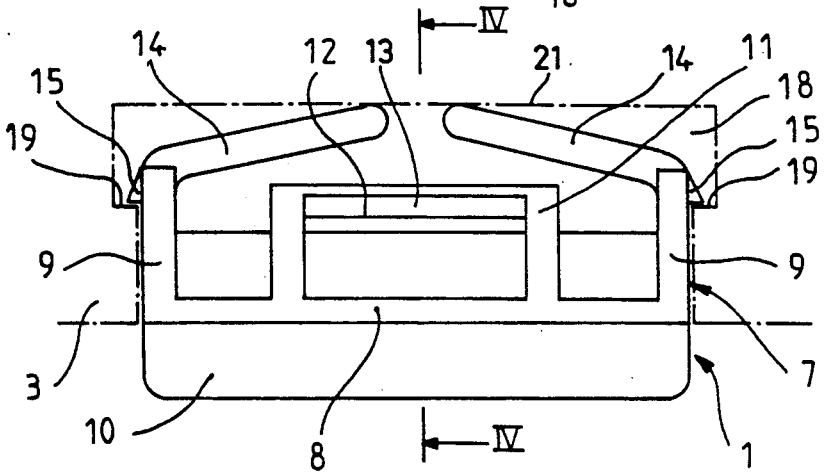
FIG. 2 is a plan view of the clasp of FIG. 1, after mounting thereof in the case.
Figure 3:
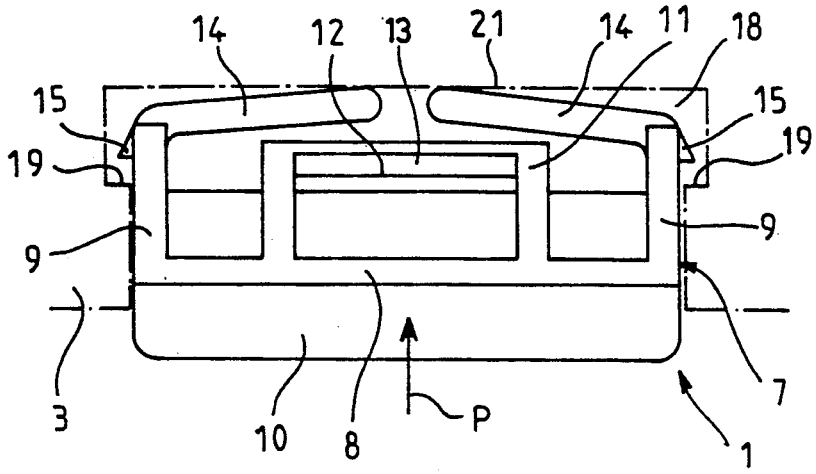
FIG. 3 is a view similar to that of FIG. 2, showing the clasp after its actuation by manual pressure.
Figure 4:
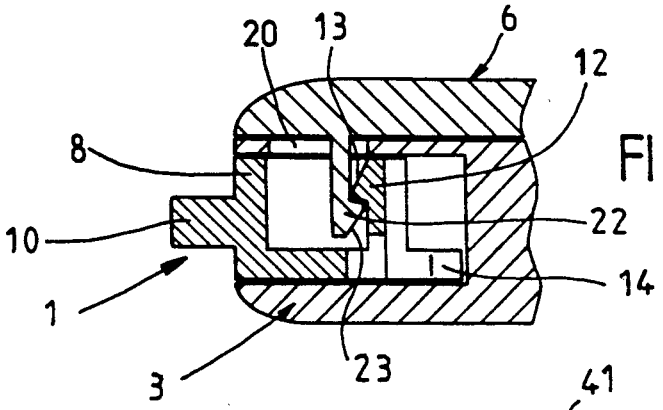
FIG. 4 is a cross-section along IV—IV of FIG. 2.

According to FIGS. 1 to 4, a one-piece clasp made of plastic material, for example polyacetal, is intended to be mounted by sliding in the direction of the arrow 2 in FIG. 1 in a part 3 of a case, via an opening 4 provided in the portion 5 of the case part 3. In the example shown, the case part 3 is the lower part or bottom part of a case, the upper part 6 or top part of which, visible in FIG. 4, is articulated to the lower part 3 on the opposite side from the portion 5 in a manner not shown.

The clasp 1 comprises a body 7 of parallele-pipedal general external shape. More precisely, the body 7 has, seen in plan, the shape of a U, the core of the U constituting the large outer portion 8 of the body 7 and the two wings of the U constituting the two small opposite portions 9 of the body 7.

On the portion 8 an outwardly projecting rib 10 is formed over the entire length of the portion 8, this rib 10 serving as means for actuating the clasp 1.

The portion 8 additionally carries, on the inside, an upwardly open cage 11, of which the side opposite the portion 8 terminates towards the top in a hook-shaped head 12, of which the flank 13 facing the portion 8 is inclined in the form of a ramp.

The two portions 9 of the body 7 are extended on the opposite side from the portion 8 by two converging oblique branches 14 terminating a short distance from one another.

At the location of the junction of the branches 14 with the lateral portions 9 of the body 7 of the clasp 1, each portion 9 comprises a catch 15 projecting laterally outwards. Each catch 15 is defined, on the side facing the portion 8, by a flank 16 perpendicular to the portion 9 and, on the side facing the branch 14, by an oblique, ramp-forming flank 17 (see FIG. 1).

The opening 4 provided in the case part 3 for receiving the clasp 1 has a height very slightly greater than the height of the body 7 of the clasp. The width of the opening 4 is very slightly greater than the width of the body 7 at the location of its portions 9, excluding the catches 15, but less than the overall width of the body 7 at the location of the catches 15.

Inside the case part 3, the opening 4 leads into a cavity 18 the width of which is greater than the overall width of the body 7 of the clasp 1 at the location of the catches 15, this cavity being joined by two shoulders 19 to the opening 4. The depth of the cavity 18 is slightly less than the distance separating the flanks 16 of the catches 15 of the body 7 of the clasp 1 from the free ends of the branches 14 perpendicularly to the plane of the portion 8 of the body 7.

The case part 3 additionally has, in its upper face, an opening 20 the function of which will become apparent hereinbelow.

The clasp 1, as described below and illustrated in FIGS. 1 to 4, can be mounted in the case part 3 by introduction, in the direction of the arrow 2, into the opening 4, the branches 14 facing forwards. During this introduction movement, the portions 9 of the body 7 bend slightly inwards as the catches 15 pass into the opening 4, and then spring back as soon as the catches 15 have cleared the shoulders 19, snapping in behind these shoulders. Shortly before this snapping-in of the catches 15 behind the shoulders 19, the free ends of the branches 14 touch the back 21 of the cavity 18, so that when the catches 15 are snapped in behind the shoulders 19, the branches 14 are slightly bent elastically. Thus, under the effect of the elasticity of the branches 14, the flanks 16 of the catches 15 are brought to bear against the shoulders 19 which serve as stops, preventing the clasp 1 once introduced into the case part 3 as is visible in FIG. 2 from coming out of the case part 3 again.

In this mounting position, the catches 15 do not hinder mobility of the clasp 1 counter to the return effect of the bent elastic branches 14, under the action of pressure exerted manually on the actuating rib 10 in the direction of the arrow as shown in FIG. 3.

As can be seen in FIG. 4, the upper case part 6 comprises a locking hook 22 which, as the case is closed, passes through the opening 20 in the lower case part 3 and cooperates with the hook 12 of the clasp 1 as a result of the sliding of the ramp 23 of the hook 22 on the ramp 13 of the hook 12 until the two hooks are snapped in behind one another.

In order to unlock the two hooks 22 and 12 for the purpose of opening the case, pressure is exerted on the rib 10 of the clasp 1 in the direction of the arrow P in FIG. 3, so that the clasp 1 is pressed in counter to the return effect of the branches 14 which bend elastically, thereby enabling the hook 22 to be released from the hook 12 when a torque is exerted on the upper case part 6 in the direction of opening, either manually or by an elastic means known per se.

Figure 5:
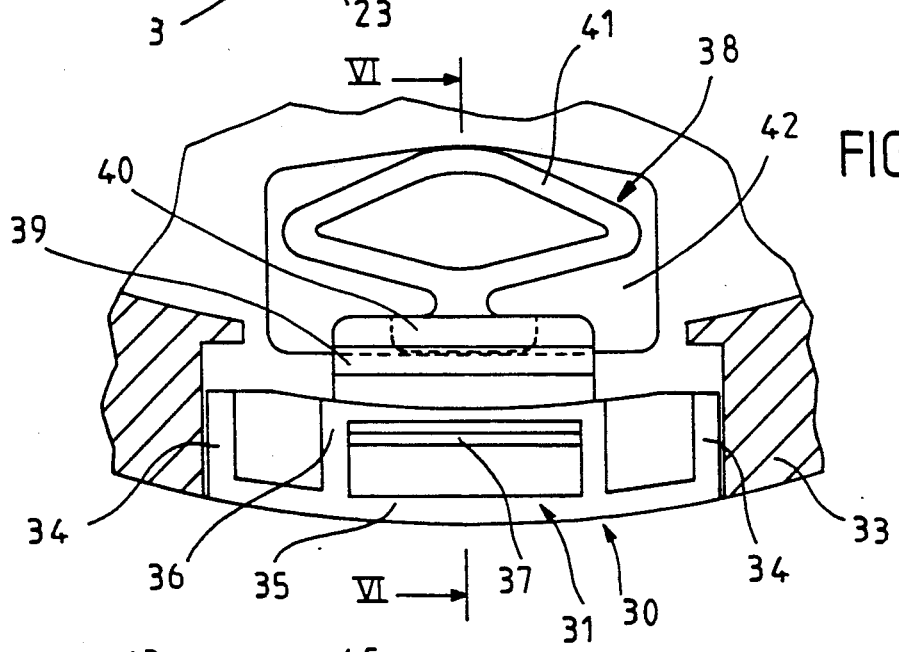
FIG. 5 shows, in cross-section along V—V of FIG. 6, a clasp according to a second embodiment of the invention, after mounting thereof.
Figure 6:
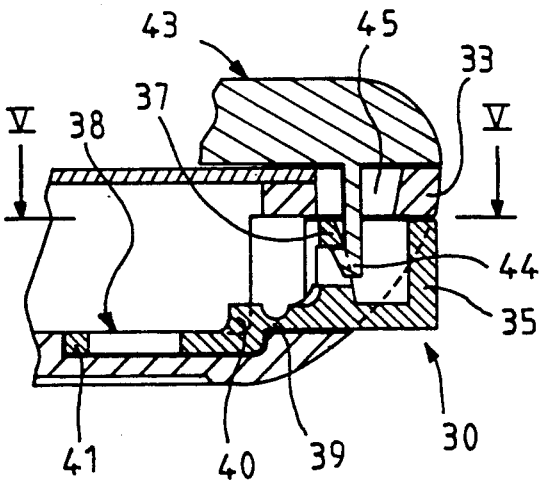
FIG. 6 is a cross-section along VI—VI of FIG. 5.
Figure 7:
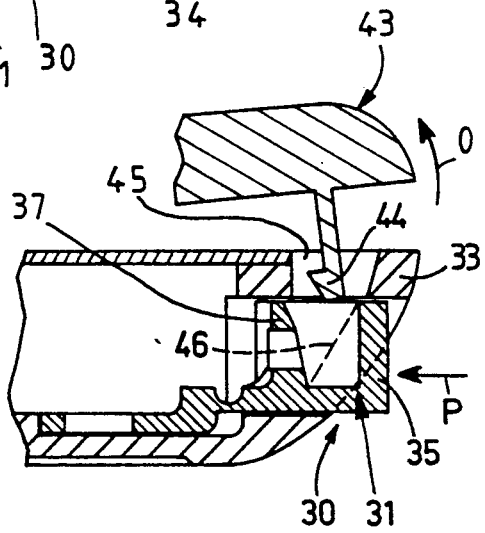
FIG. 7 is a cross-section similar to that of FIG. 6, showing the clasp actuated by manual pressure.

According to FIGS. 5 to 7, a clasp 30 comprises a body 31 slidably mounted in an opening 32 in a lower case part 33. Seen in plan, the clasp body 31 has the shape of a U, with two parallel lateral wings 34 forming the small portions of the body 31 and a core 35 which here forms a large portion inwardly curved in accordance with the inwardly curved shape of the edge of the case part 33, as is visible in FIG. 5. A cage 36 formed on the inner face of the portion 35 of the body 31 has, on the opposite side from the portion 35, a hook-shaped side 37 as can better be seen in FIGS. 6 and 7.

The body 31 of the clasp 30 is extended rearwards, at the base of the side of the cage 36 forming the hook 37, by a flat part 38 offset downwards relative to the lower face of the body 31 of the clasp 30. As can be seen especially in FIGS. 6 and 7, the part 38 constitutes a pallet connected to the body 31 by a horizontal elastic articulation 39 defined by a weakening of the material at the location of the junction of the pallet 38 with the body 31. The pallet 38 comprises a rigid retention part 40, adjacent to the articulation 39, followed by an elastic return part 41 constituting a closed loop having the general shape of a diamond.

The case part 33 has, for receiving the pallet 38 of the body 31, in the extension of the opening 32, a hollow 42 of rectangular general shape, the width of which is greater than the width of the pallet 38 and the length of which corresponds substantially to the length of the part 38.

For mounting the clasp 30 in the case part 33, the clasp 30 is introduced, with the pallet 38 facing forwards, into the opening 32, the height and width of which are slightly greater than the height and width of the body 31. During this movement of introduction by sliding, the pallet 38 can bend elastically upwards about the articulation 39.

As soon as the pallet 38 has reached the hollow 42 of the case part 33, it penetrates into the hollow 42, springing back elastically. The hollow 42 thus constitutes both the bearing means for the loop 41 serving as elastic return means, the free end of which bears against the front flank of the hollow 42, and stop means preventing the clasp 30 from coming out of the case part 33 again, the retention part 40 of the pallet 38 coming to bear against the front flank of the hollow 42.

Thus, upon closure of the case by turning down an upper case part 43 onto the lower case part 33, the hook 44 of the upper case part 43, passing through the opening 45 in the case part 33, is locked behind the hook 37 of the clasp 30, as is visible in FIG. 6.

In order to open the case, pressure is exerted in the direction of the arrow P in FIG. 7 on the portion 35 of the body 31 of the clasp 30 in order to press in the body 31 counter to the return effect of the loop 41 which is thus deformed elastically, until the hook 44 of the upper case part 43 is freed by the hook 37 of the clasp 30 and the two case parts 43, 33 can be separated from one another, either manually or automatically by elastic means, not shown, as indicated by the arrow 0. It is also possible to provide, for this purpose, as indicated by broken lines in FIG. 7, a ramp 46 on the portion 35 of the body 31 of the clasp 30, facing the hook 37, so as to exert, when pressing in the clasp 30, after freeing of the hook 44 by the hook 37, a mechanical action in the opening direction 0 on the upper case part 43.

I claim:

1. Case composed of two parts articulated to one another, a first part of which has an opening for receiving a one-piece clasp comprising a body which is slidably mounted in the said opening and constructed so that it can be introduced into the said first case part by sliding through the said opening and on which are provided elastic return means for urging the body elastically counter to the direction in which the first case part is introduced, means, accessible from outside, for actuation through the said opening, for displacing the body by manual pressure counter to the said return means, locking means for keeping the case closed and retention means for cooperating, at the end of the mounting of the body in the first case part, by snapping in, with stop means provided on the said first case part so as to enable the said locking means to cooperate, in this position, with hooking means on the second part of the case, said body having an extension, the return means being formed in the extension of the said body in the direction in which the body is introduced into the first case part, so as to cooperate, by elastic bending, with a bearing surface provided on the said first case part, characterised in that the clasp body (7) has the general shape of a U, in that the said elastic return means consist of two branches (14) each formed in the extension of one of the two wings of the U-shaped body (7), in that the said retention means are lateral catches (15) projecting laterally from the said wings (9) of the U-shaped body (7) at the root of the said branches, and in that the said stop means (19) consist of the opposite interior lateral edges of the said opening (4) in the first case part (3).

2. Case composed of two parts articulated to one another, a first part of which has an opening for receiving a one-piece clasp comprising a body which is slidably mounted in the said opening on which are provided elastic return means for urging the body elastically counter to the direction in which the first case part is introduced, means, accessible from outside, for actuation through the said opening, for displacing the body by manual pressure counter to the said return means, locking means for keeping the case closed and retention means for cooperating, at the end of the mounting of the body in the first case part, by snapping in, with stop means provided on the said first case part so as to enable the said locking means to cooperate, in this position with hooking means on the second part of the case, said body having an extension, the return means being formed in the extension of the said body in the direction in which the body is introduced into the first case part, so as to cooperate, by elastic bending, with a bearing surface provided on the said first case part, characterised in that the said elastic return means (41) and the said retention means (40) are formed on a part (38) offset downwards relative to the lower edge of the clasp body (31) and connected to the latter with the possibility of elastic pivoting in the vertical plane so as to be able to engage elastically, upon introduction of the clasp into the first case part (33), in a hollow (42) made in the first case part (33) so that, in the direction in which the clasp is introduced into the first case part, the front flank of the said hollow (42) constitutes the stop means for the said retention means (40) and the rear flank of the said hollow (42) constitutes the bearing means for the said elastic return means (41).

3. Case according to claim 2, characterised in that the elastic return means (41) have the form of an elastically deformable closed loop.

4. Case according to claim 3, characterised in that the said loop has the form of a diamond.

5. Case according to claim 2, characterised in that the clasp has a weakened region, serving as pivot axis, at the location of the junction of the said pivoting part (38) with the clasp body (31).

* * * * *